US007341469B2

(12) United States Patent
Frye

(10) Patent No.: US 7,341,469 B2
(45) Date of Patent: Mar. 11, 2008

(54) ADAPTER FOR A RECESSED LAMP

(75) Inventor: Lambert Frye, Steinheim (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 0 days.

(21) Appl. No.: 11/797,414

(22) Filed: May 3, 2007

(65) Prior Publication Data

US 2007/0259549 A1 Nov. 8, 2007

(30) Foreign Application Priority Data

May 5, 2006 (DE) ..... 10 2006 021 055

(51) Int. Cl.
*H01R 33/08* (2006.01)

(52) U.S. Cl. ..... 439/236

(58) Field of Classification Search ..... 439/236, 439/239, 699.2, 223; 362/364, 439, 84; 315/101, 315/59; 313/573; 200/51 R, 51.17
See application file for complete search history.

(56) References Cited

U.S. PATENT DOCUMENTS 4,156,265 A * 5/1979 Rose ..... 361/179
4,214,135 A * 7/1980 Munroe ..... 200/51.17
4,495,443 A * 1/1985 Cummings ..... 315/58
4,821,161 A * 4/1989 Koontz ..... 362/364
4,936,789 A * 6/1990 Ugalde ..... 439/236
5,320,548 A * 6/1994 Schadhauser ..... 439/236
5,390,096 A * 2/1995 DeKleine et al. ..... 362/346
6,059,593 A * 5/2000 Pasternak ..... 439/236
6,075,318 A * 6/2000 Noll et al. ..... 313/573
6,168,282 B1 * 1/2001 Chien ..... 362/84
6,402,555 B1 * 6/2002 Garcia et al. ..... 439/620.01
6,494,730 B1 * 12/2002 Yan ..... 439/226
7,300,173 B2 * 11/2007 Catalano et al. ..... 362/208

FOREIGN PATENT DOCUMENTS

WO 98/40936 9/1998

* cited by examiner

*Primary Examiner*—Alexander Gilman
(74) *Attorney, Agent, or Firm*—William E. Meyer

(57) ABSTRACT

An adapter for providing a recessed lamp in a screw-type lampholder. This adapter has an electrical contact-making device, via which an electrical connection is produced between a screw base, which can be introduced into the screw-type lampholder, of the adapter and the recessed lamp once the recessed lamp has been introduced into the adapter. Furthermore, the adapter has a switchable electrical connecting device, via which, in the state in which there is no mechanical connection between an enveloping bulb for the recessed lamp and the adapter, an electrical connection is not produced between the screw base and the recessed lamp, and via which, in the state in which the recessed lamp is surrounded, at least in sections, by the enveloping bulb, an electrical connection is produced between the screw base and the recessed lamp. As a result, the recessed lamp in the adapter can only be operated with the enveloping bulb placed thereon.

12 Claims, 3 Drawing Sheets

ADAPTER FOR A RECESSED LAMP

TECHNICAL FIELD

The invention relates to an adapter for a recessed lamp, in particular a recessed halogen lamp, and to an adapter for a recessed lamp with an enveloping bulb.

BACKGROUND ART

Owing to their good light quality and long life, recessed lamps are increasingly widespread in many areas of daily life. Even in applications with high requirements in terms of esthetics and efficiency it has become desirable to replace conventional incandescent lamps operating on the system voltage with halogen incandescent lamps. For these reasons, lamps with inserted halogen incandescent lamps have been developed which are surrounded by an enveloping bulb and, as a result, outwardly barely differ from conventional incandescent lamps for general lighting.

Such a lamp is described, for example, on the Internet domain www.osram.de under the product designation "HALOLUX®T". With these lamps, a recessed halogen lamp with a pinch seal at one end is inserted into a base via an electrically conducting mounting clip and surrounded by an enveloping bulb. As in the case of conventional incandescent lamps, in the event of a failure of such a halogen incandescent lamp it needs to be completely replaced, i.e. including the base and the enveloping bulb.

Dimmable high-volt halogen incandescent lamps having a long life and a short overall length, as are described, for example, on the Internet domain www.osram.de under the product designation "HALOPIN®", are permissible for operation in open luminaires, but have a high surface temperature. Owing to this high surface temperature, general use in old luminaires in which, for example, the screw-type lampholder E27 is used, is not recommended. Such high-volt halogen incandescent lamps are designed to have an integrated safety function and have a dedicated base/lampholder system, in the case of the incandescent lamp "HALOPIN®", a plug-in system with the designation G9. Owing to this plug-in system, it is also not possible to use these high-volt halogen incandescent lamps in screw-type lampholders.

The patent specification U.S. Pat. No. 6,075,318 has disclosed a high-volt halogen incandescent lamp having a lampholder on which a screw base is provided. A first contact to a first power supply to the lamp is in touching contact with the side contact of the screw base, while a second cable extends from a bottom contact of the screw base to a second contact to a second power supply to the lamp. The outer bulb around the halogen incandescent lamp is simply a design feature owing to a projection having the function of protection against electric shock.

DISCLOSURE OF THE INVENTION

The invention is based on the object of providing an adapter for providing a recessed lamp in a screw-type lampholder and an adapter with an enveloping bulb, which, in comparison with conventional solutions, make it possible to provide compact high-volt incandescent lamps in a screw-type lampholder whilst adhering to the electrical safety requirements.

This object is achieved by an adapter for providing a recessed lamp in a screw-type lampholder having an electrical contact-making device, via which an electrical connection is produced between a screw base, which can be introduced into the screw-type lampholder, of the adapter and the recessed lamp once the recessed lamp has been introduced into the adapter, and a switchable electrical connecting device, via which, in the state in which there is no mechanical connection between an enveloping bulb for the recessed lamp and the adapter, an electrical connection is not produced between the screw base and the recessed lamp, and via which, in the state in which the recessed lamp is surrounded, at least in sections, by the enveloping bulb, an electrical connection is produced between the screw base and the recessed lamp.

This object is also achieved by an adapter as described above having an enveloping bulb.

An adapter according to the invention for providing a recessed lamp in a screw-type lampholder has an electrical contact-making device, via which an electrical connection is produced between a screw base, which can be introduced into the screw-type lampholder, of the adapter and the recessed lamp once the recessed lamp has been introduced into the adapter, and a switchable electrical connecting device, via which, in the state in which there is no-mechanical connection between an enveloping bulb for the recessed lamp and the adapter, an electrical connection is not produced between the screw base and the recessed lamp, and via which, in the state in which the recessed lamp is surrounded, at least in sections, by the enveloping bulb, an electrical connection is produced between the screw base and the recessed lamp. Therefore, electrical current is fed to the recessed lamp only when the enveloping bulb has been fitted onto the recessed lamp. Owing to the enveloping bulb having been fitted, the temperature of the outwardly pointing surface of the assembly comprising the recessed lamp, the adapter and the enveloping bulb can be reduced to a low temperature level, and therefore a recessed lamp which has a high surface temperature can also safely be used in screw-type lampholders.

It is preferred for the switchable electrical connecting device to have a contact spring with a switching lever, by means of which the contact spring can be brought into bearing contact with a contact element for the external power supply to the recessed lamp, with the result that switching of the recessed lamp takes place by a simple and therefore cost-effective mechanical device.

Preferably, the contact spring is connected to a bottom contact of the adapter, with the result that the switchable contact is such that its power supply depends on the screw-in depth into the screw-type lampholder, and the level of safety is therefore increased.

In one preferred configuration, the switching lever can be actuated by the enveloping bulb being placed on top. This simple mechanical switching produces a high degree of operational reliability.

Furthermore, it is preferred for the contact spring to be capable of being brought into bearing contact with the external power supply to the recessed lamp via an arcuate section. Even in the case of a change in the spring force owing to frequent replacement of the recessed lamp, a reliable electrical contact can therefore be produced.

The adapter according to the invention preferably has opposing bearing faces, with which a base of the recessed lamp can be brought into bearing contact when said recessed lamp is inserted into the adapter. As a result, both the mechanical connection and the electrical connection between the recessed lamp and the adapter can be performed by the recessed lamp being plugged in.

Preferably, the electrical contact-making device has a spring element with two arcuate sections, of which one produces the electrical connection with a further contact element for the external power supply to the recessed lamp and the other is electrically connected to the screw base when the recessed lamp has been introduced into the adapter. It is thus possible for an operationally reliable adapter to be realized without any additional solder joints.

It is preferred for the recessed lamp to be a halogen lamp, in particular a high-volt halogen incandescent lamp. As a result, small physical sizes with a high degree of operational reliability and a long life can also be realized for lamps in screw-type lampholders.

In addition, an adapter in accordance with one of the abovementioned configurations having an enveloping bulb is provided. Owing to the enveloping bulb, a low- surface temperature is ensured when the recessed lamp is introduced.

The enveloping bulb preferably has an adapter-side constriction for engaging with at least one spring element of the adapter for the mechanical connection between the enveloping bulb and the adapter. As a result, the enveloping bulb can be placed onto the adapter in a simple manner.

In one further preferred configuration, in the case of a mechanical connection between the adapter and the enveloping bulb, an end face of the switching lever is in bearing contact with a bearing face of the adapter-side constriction of the enveloping bulb, and the electrical connection is produced between the screw base and the recessed lamp. In this manner, the constriction is also used for producing the electrical connection. As a result, a mechanically simple assembly comprising the adapter and the enveloping bulb can be realized.

BRIEF DESCRIPTION OF THE DRAWINGS

The invention will be explained in more detail below with reference to preferred exemplary embodiments. In the drawings.

BEST MODE FOR CARRYING OUT THE INVENTION

Figure 1:
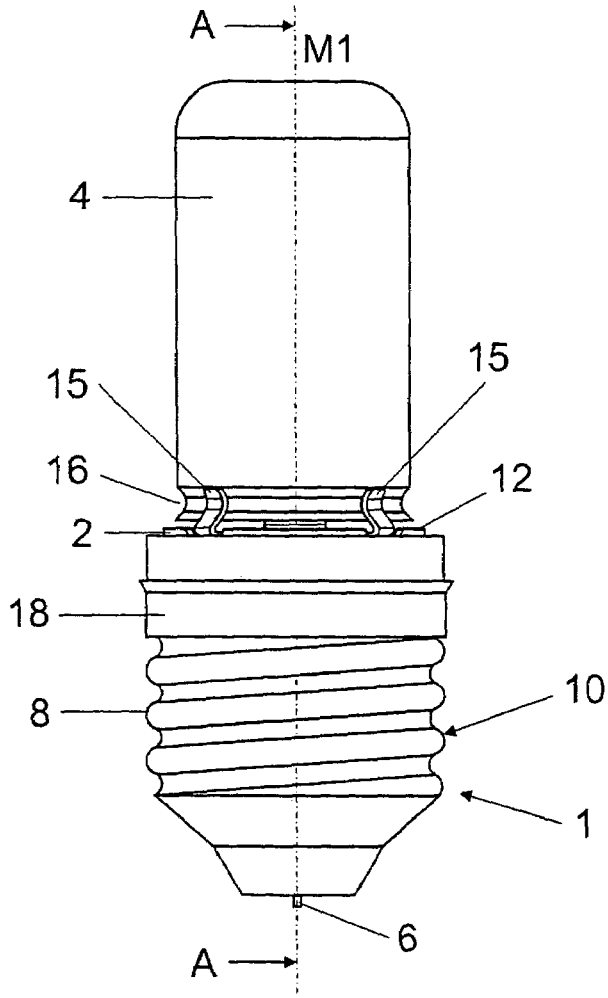
FIG. 1 shows a side view of an adapter according to the -invention with a lamp introduced and an enveloping bulb placed thereon.

FIG. 1 shows a side view of an adapter 1 according to the invention, which is mechanically connected to an enveloping bulb 4 via a spring ring 2. The adapter 1 has a screw base 10, of the type E27 in the exemplary embodiment illustrated, on its outer face, which screw base has a central bottom contact 6 and a threaded section 8, which is delimited by the outer circumference of the adapter.

The spring ring 2 with four restraining springs 14 is arranged on the upper side 12 of the adapter 1 opposite the bottom contact 6, which restraining springs engage in a constriction 16 on the adapter-side end section of the enveloping bulb when there is a mechanical connection between the adapter 1 and the enveloping bulb 4. The free end sections 15 of the restraining springs 14 are bent outwards in the radial direction such that the enveloping bulb 4 can be introduced between the restraining springs 14. The spring force of the restraining springs 14 which acts radially inwards holds the enveloping bulb 4 on the adapter 1.

Figure 2:
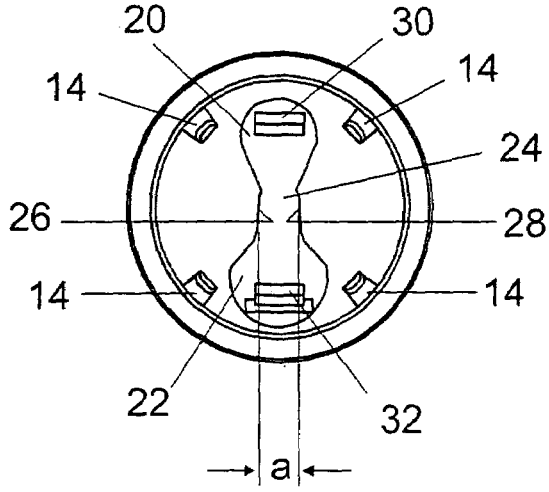
FIG. 2 shows a plan view of the adapter without a recessed lamp and enveloping bulb.

FIG. 2 shows a plan view of the adapter 1 with the enveloping bulb 4 removed. Two cutouts 20, 22 each with an elliptical cross section are introduced into the base housing 18, which is delimited by the threaded section 8 of the adapter 1 in the circumferential direction, which cutouts are connected to one another by a connecting cutout 24. The connecting cutout 24 has two opposing bearing faces 26, 28. A respective contact spring 30, 32 extends essentially parallel to the mid-axis M1 of the adapter 1 from the bottom of the respective cutout 20, 22. The base housing 18 is formed from a nonconductor, preferably from synthetic resin.

Figure 3:
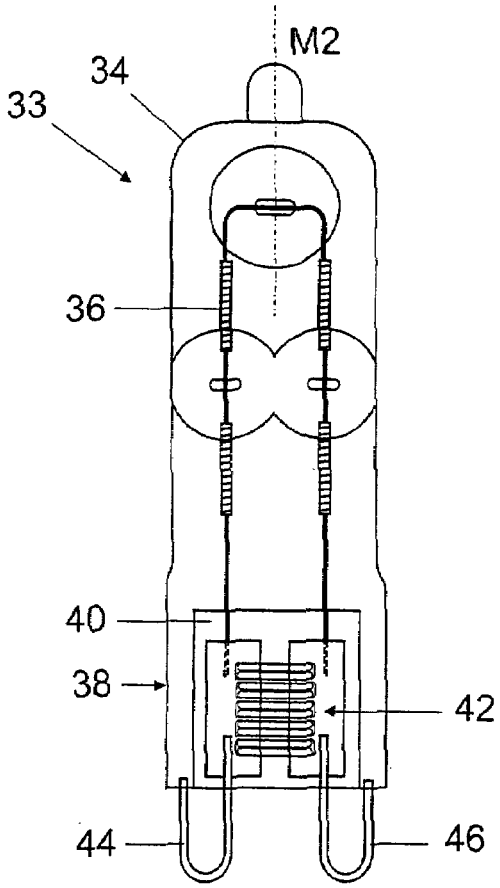
FIG. 3 shows a front view of a recessed lamp in the form of the high-volt halogen incandescent lamp "HALOPIN®"
Figure 4:
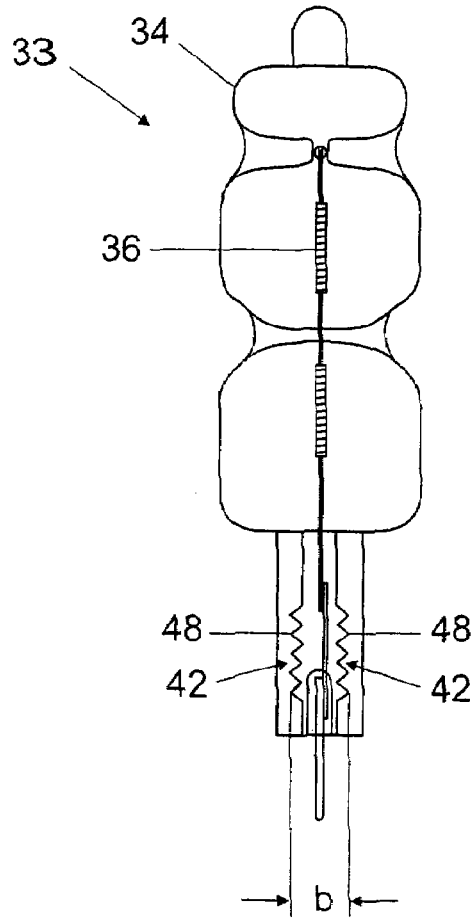
FIG. 4 shows a side view of the high-volt halogen incandescent lamp "HALOPIN®" from FIG. 3.

FIG. 3 shows a front view of a recessed lamp in the form of the high-volt halogen incandescent lamp "HALOPIN®" and FIG. 4 shows a side view of this high-volt halogen incandescent lamp. Such a high-volt halogen incandescent lamp has a lamp vessel 34 having an incandescent filament 36 introduced. The base section 38 of the lamp vessel 34 is provided with a pinch seal 40, on whose opposite sides retaining pimples 42 are formed. Two contact elements 44, 46 are formed essentially in each case in the form of a U on the base section 38, via which contact elements power is supplied to the end sections of the incandescent filament 36.

The distance a shown in FIG. 2 between the bearing faces 26, 28 of the connecting cutout 24 is selected to be equal to the distance b shown in FIG. 4 between the protruding curvatures 48 of the retaining pimples or to be smaller than this, with the result that, once the pinch seal 40 has been introduced between the bearing faces 26, 28 of the connecting cutout 24, the retaining pimples and, by means of these, the pinch seal 40 are held in the connecting cutout 24. In this manner, the recessed lamp 33 is arranged in mechanically stable fashion in the adapter 1.

Figure 5:
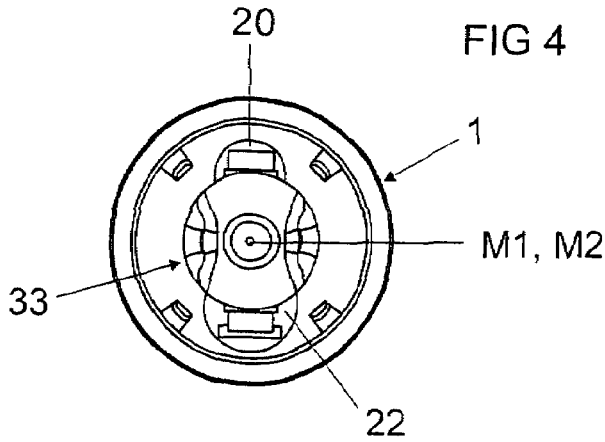
FIG. 5 shows a plan view of the adapter with the recessed lamp inserted and the enveloping bulb removed.

FIG. 5 illustrates the recessed lamp 33 introduced into the adapter 1. The mid-axis M1, illustrated in FIG. 1, of the adapter 1 in this case coincides with the mid-axis M2, illustrated in FIG. 3, of the recessed lamp 33, with the result that the incandescent filament 36 is provided in a central position of the adapter at the greatest possible distance from the circumference of the adapter 1. The contact element 44 of the recessed lamp 33 shown in FIG. 3 is arranged in FIG. 5 in the cutout 20, and the contact element 46 in the cutout 22.

Figure 6:
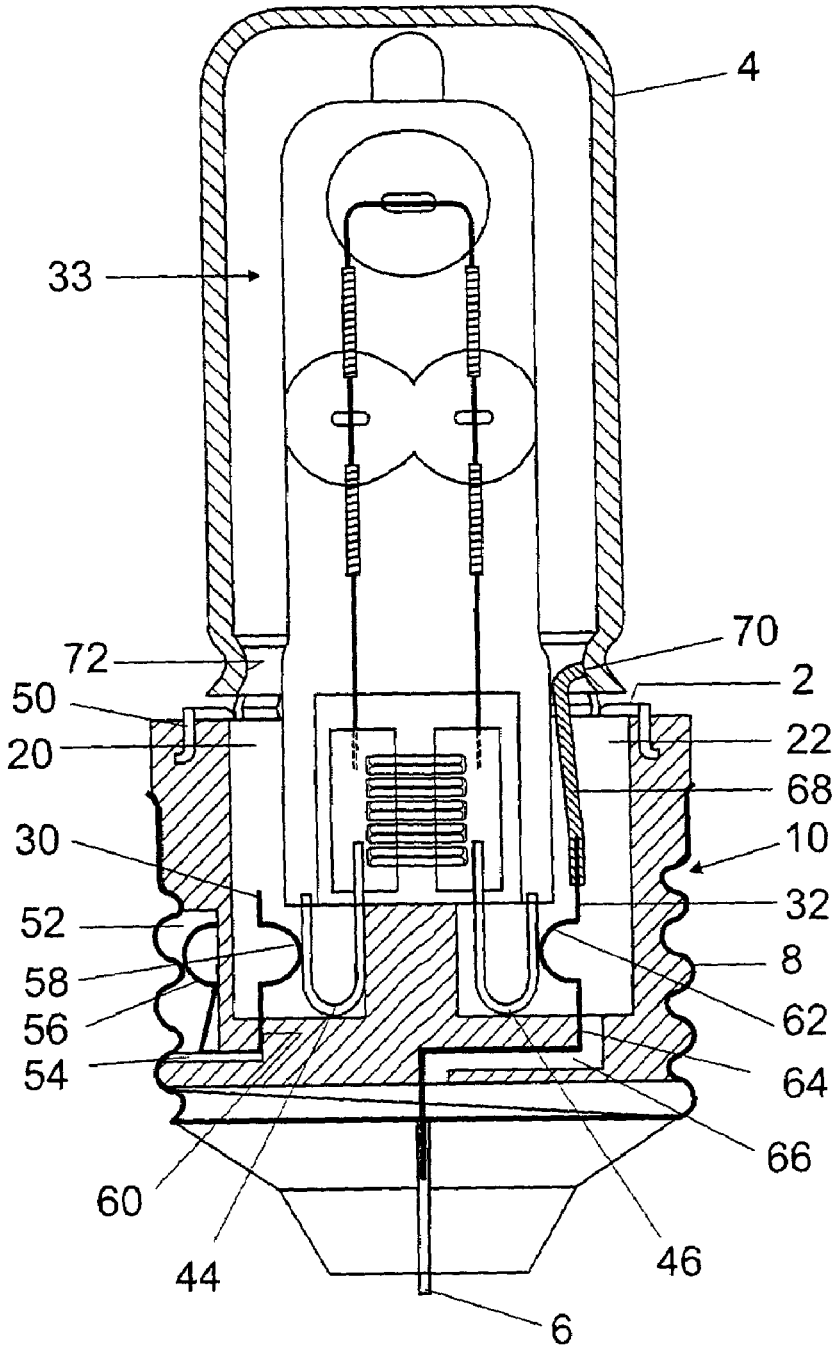
FIG. 6 shows a cross-sectional view of the adapter with the recessed lamp introduced and the enveloping bulb placed thereon from FIG. 1.

FIG. 6 illustrates a cross-sectional view in the plane A-A of the adapter 1 with the recessed lamp introduced and the enveloping bulb placed thereon, from FIG. 1. The spring ring 2 has, at its end section, opposite to the restraining springs 14 in the axial direction, fixing projections 50, via which the spring ring 2 is held in the base housing 18.

A spring space 52 is provided radially outside of the cutout 20 in the adapter 1, which spring space is connected to the cutout 20 via a spring channel 54. The contact spring 30 is essentially in the form of a U and has an outwardly pointing arc section 56, 58 on each limb. The foot section 60 of the contact spring 30 runs in the spring channel 54. With the recessed lamp 33 introduced into the cutout 20, the arc section 58 is in engagement with the contact element 44 and, at the same time, the arc section 56 in the spring space 52 is pushed against the inner circumference of the threaded section 8 of the adapter 1. The contact spring 30 therefore forms an electrical contact-making device, which produces an electrical connection between the contact element 44 of the recessed lamp and the inner circumference of the threaded section 8 of the adapter 1 when, the recessed lamp 33 is inserted into the adapter 1.

Preferably, the foot section 60 of the contact spring 30 is provided such that it cannot move in the spring channel 54, the arc section 56 of the contact spring 30 also being pushed against the inner circumference of the threaded section 8 when the recessed lamp 33 is not introduced into the adapter, and the arc section 58 is prestressed from the foot point 60 with such a prestress that reliable contact exists between the contact element 44 and the threaded section 8 even once the recessed lamp 33 has been replaced a number of times.

The contact spring 32 in the cutout 22 has an arc section 62 which points towards the contact element 46 and produces a switchable electrical connection between the contact spring 32 and the contact element 46 of the recessed lamp when the recessed lamp 33 is introduced into the adapter 1. The foot section 62 of the contact spring 32 is preferably provided rigidly in a spring channel 66 of the base housing 18 and is electrically connected to the bottom contact 6 of the adapter 1. The contact spring 32 has, in the direction of the spring ring 2, a switching lever 68, preferably consisting of an electrically insulating material, such as synthetic resin, for example. The switching lever 68 is bent radially outwards adjacent to the spring ring 2 and has an end face 70, which is in bearing contact with an inner circumferential face 72 in the region of the constriction 16 of the enveloping bulb 4 when the enveloping bulb 4 has been placed onto the adapter 1.

The contact spring 32 with the switching lever 68 has been dimensioned such that, when the recessed lamp 33 has been introduced into the-adapter 1 and the enveloping bulb 4 has been removed, the contact spring 32 of the adapter 1 is not in bearing contact with the contact element 46 of the recessed lamp 33, with the result that, in the case of an adapter 1 which is inserted into a live screw-type lampholder, the contact element 44 is electrically connected to the threaded section 8 via the contact spring 30, but no power is supplied to the contact element 46, despite power being supplied via the bottom contact 6 to the contact spring 32, owing to the lack of bearing contact between the contact spring 32 and the contact element 46. In this manner, a voltage supply to the recessed lamp 33 is avoided when the enveloping bulb has not been placed thereon.

If the enveloping bulb 4 has been placed onto the adapter 1, the end face 70 of the switching lever 68 is in bearing contact with the inner circumferential face 72 of the constriction 16 of the enveloping bulb 4. Owing to this bearing contact, the arc section 62 is pressed against the contact element 46, and an electrical connection is therefore produced between the bottom contact 6 and the contact element 46.

The invention discloses an adapter for providing a recessed lamp in a screw-type lampholder. This adapter has an electrical contact-making device, via which an electrical connection is produced between a screw base, which can be introduced into the screw-type lampholder, of the adapter and the recessed lamp once the recessed lamp has been introduced into the adapter. Furthermore, the adapter has a switchable electrical connecting device, via which, in the state in which there is no mechanical connection between an enveloping bulb for the recessed lamp and the adapter, an electrical connection is not produced between the screw base and the recessed lamp, and via which, in the state in which the recessed lamp is surrounded, at least in sections, by the enveloping bulb, an electrical connection is produced between the screw base and the recessed lamp. As a result, the recessed lamp in the adapter can only be operated with the enveloping bulb placed thereon.

What is claimed is:

1. An adapter for providing a recessed lamp in a screw-type lampholder having an electrical contact-making device, via which an electrical connection is produced between a screw base, which can be introduced into the screw-type lampholder, of the adapter and the recessed lamp once the recessed lamp has been introduced into the adapter, and a switchable electrical connecting device, via which, in the state in which there is no mechanical connection between an enveloping bulb for the recessed lamp and the adapter, an electrical connection is not produced between the screw base and the recessed lamp, and via which, in the state in which the recessed lamp is surrounded, at least in sections, by the enveloping bulb, an electrical connection is produced between the screw base and the recessed lamp.

2. The adapter as claimed in claim 1, the contact spring being capable of being brought into bearing contact with the external power supply to the recessed lamp via an arcuate section.

3. The adapter as claimed in claim 1, which has opposing bearing faces, with which a base of the recessed lamp can be brought into bearing contact when said recessed lamp is inserted into the adapter.

4. The adapter as claimed in claim 1, the electrical contact-making device having a spring element with two arcuate sections, of which one produces the electrical connection with a further contact element for the external power supply to the recessed lamp and the other is electrically connected to the screw base when the recessed lamp has been introduced into the adapter.

5. The adapter as claimed in claim 1, the recessed lamp being a halogen lamp.

6. The adapter as claimed in claim 1, the switchable electrical connecting device having a contact spring with a switching lever, by means of which the contact spring can be brought into bearing contact with a contact element for the external power supply to the recessed lamp.

7. The adapter as claimed in claim 6, the contact spring being connected to a bottom contact of the adapter.

8. The adapter as claimed in claim 6, the switching lever being capable of being actuated by the enveloping bulb being placed on top.

9. The adapter as claimed in claim 6, the contact spring being capable of being brought into bearing contact with the external power supply to the recessed lamp via an arcuate section.

10. An adapter corresponding to claim 1 with an enveloping bulb.

11. The adapter as claimed in claim 10, the enveloping bulb having an adapter-side constriction for engaging with at least one spring element of the adapter for the mechanical connection between the enveloping bulb and the adapter.

12. The adapter as claimed in claim 11, in the case of a mechanical connection between the adapter and the enveloping bulb, an end face of the switching lever being in bearing contact with a bearing face of the adapter-side constriction of the enveloping bulb, and the electrical connection being produced between the screw base and the recessed lamp.

* * * * *